US006289526B1

(12) United States Patent
Chang

(10) Patent No.: US 6,289,526 B1
(45) Date of Patent: Sep. 18, 2001

(54) AUTOMATIC CLEANER FOR A TOILET SEAT

(76) Inventor: Chin-Chuan Chang, No. 24, Alley 1, Lane 347, Zhen-Chyan St., Shuh-Lin City, Taipei Hsien (TW)

( * ) Notice: Subject to any disclaimer, the term of this patent is extended or adjusted under 35 U.S.C. 154(b) by 0 days.

(21) Appl. No.: 09/639,484

(22) Filed: Aug. 16, 2000

(51) Int. Cl.[7] ..... A47K 13/00
(52) U.S. Cl. ..... 4/233
(58) Field of Search ..... 4/233

(56) References Cited

U.S. PATENT DOCUMENTS 4,536,899 * 8/1985 Schnyder ..... 4/233
4,734,942 * 4/1988 Blanchard ..... 4/233

FOREIGN PATENT DOCUMENTS

83870 * 7/1935 (CH) ..... 4/233

* cited by examiner

*Primary Examiner*—Robert M. Fetsuga
(74) *Attorney, Agent, or Firm*—Bacon & Thomas, PLLC

(57) ABSTRACT

The present invention relates to an automatic cleaner for a toilet seat which includes a cleaner and a toilet seat. The cleaner contains a washing device, a flushing device, a drier and a transmission unit while the toilet seat consists of a turning seat and a bottom seat. The turning seat of the toilet seat is rotated by means of the transmission unit within the cleaner while the flushing device within the cleaner sprays a certain amount of the cleaning liquid. Thereafter, the washing device is activated to wash. In addition, the drier dries the surface of the turning seat to achieve a clean, hygienic and warming effect.

10 Claims, 13 Drawing Sheets

AUTOMATIC CLEANER FOR A TOILET SEAT

BACKGROUND OF THE INVENTION

1. Field of the Invention

The present invention relates to an automatic cleaner for a toilet seat and, more particularly, to an automatic device for cleaning the toilet seat to achieve a clean and hygienic effect. Moreover, the seat can be warmed in the winter.

2. Description of the Prior Art

The conventional toilet seat is used for preventing the contact of the buttocks with the toilet. Later, a warming and a cleaning function thereof are developed. However, an automatic cleaning function is still not provided in the device. Thus, until now, the toilet seat is always cleaned manually, and this wastes manpower and material. Especially in winter, the cold water makes the cleaner to neglect to clean it carefully. With more demanding requirement of the cleanliness and the propagation of the infectious diseases, people have strong fear in using the toilet seat, especially at the public restroom.

SUMMARY OF THE INVENTION

It is a primary object of the present invention to provide an automatic cleaner for a toilet seat in which a cleaner contains a washing device, a flushing device, a drier and a transmission unit. A turning seat is rotated by means of the transmission unit within the cleaner while the flushing device within the cleaner sprays a certain amount of the cleaning liquid. Thereafter, the washing device is activated to wash. In addition, the drier dries the surface of the turning seat to achieve a clean and a hygienic effect.

It is a further object of the present invention to provide an automatic cleaner for a toilet seat in which a drier is provided for warming the toilet seat in the winter for maintaining an appropriate temperature.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
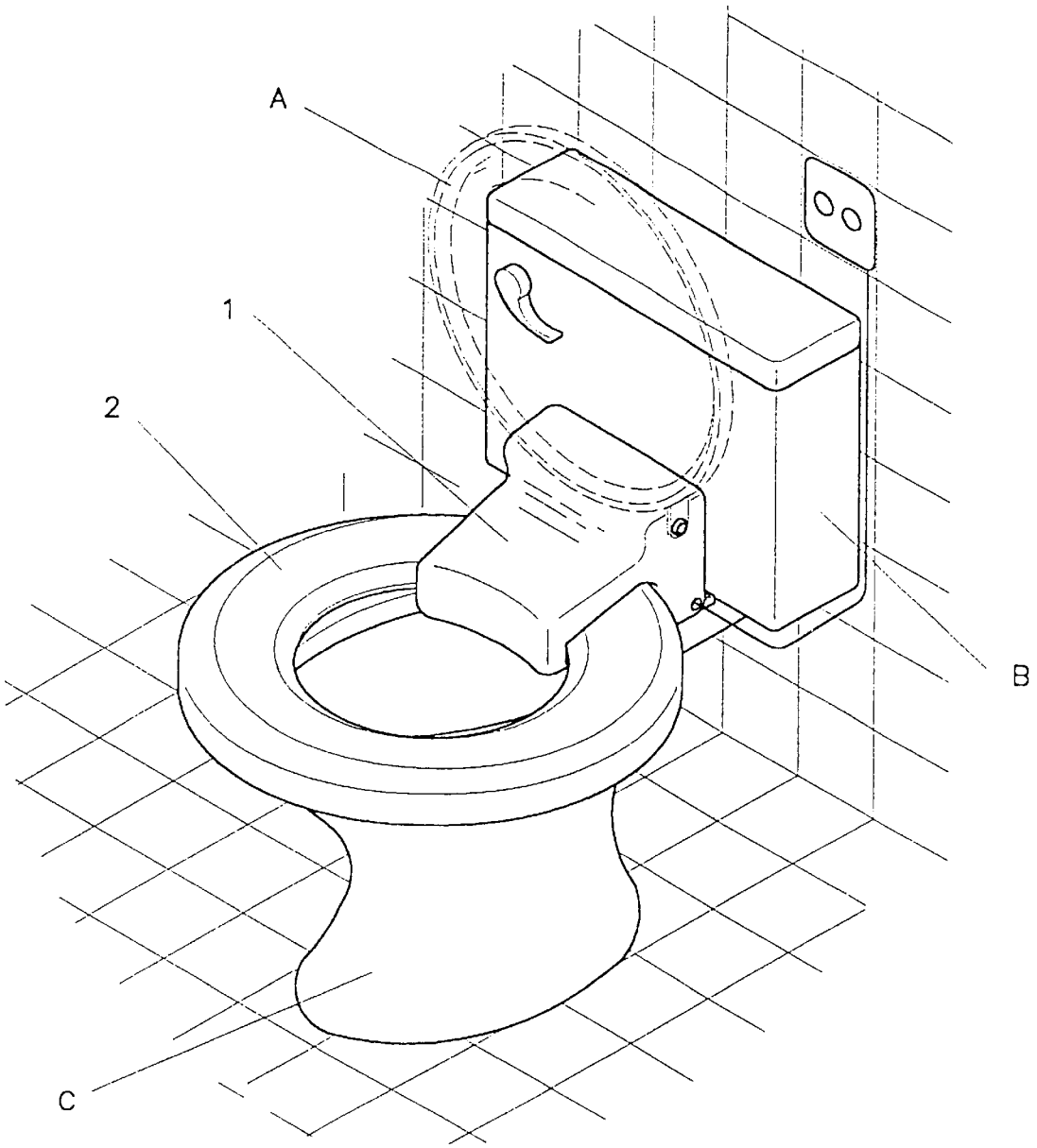
FIG. 1 is a perspective assembly view of a preferred embodiment of the present invention applied to the whole toilet.
Figure 2:
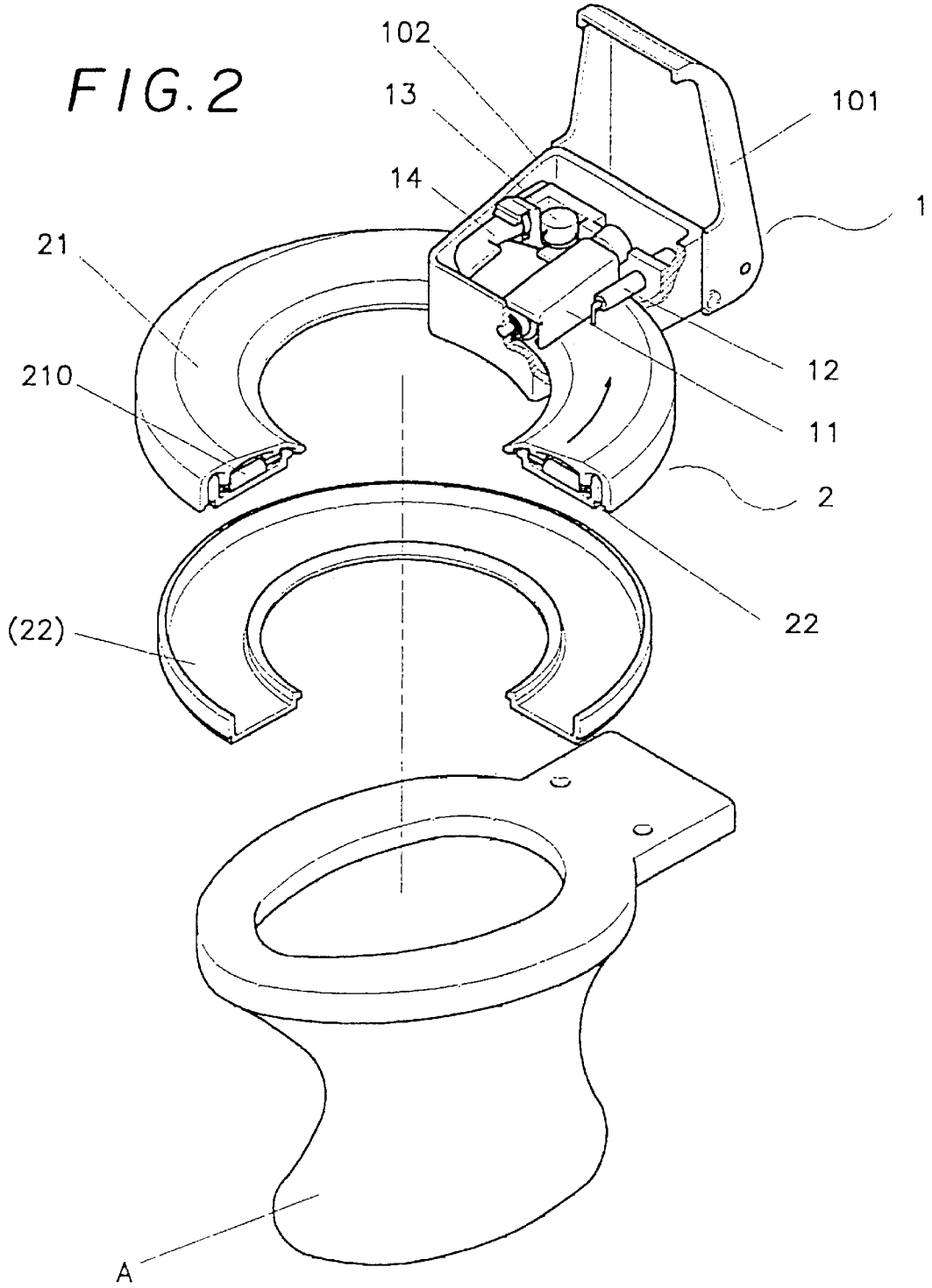
FIG. 2 is a perspective exploded view of FIG. 1.

FIG. 1 shows a perspective assembly view of a preferred embodiment of the present invention applied to the whole toilet. It's apparent in FIG. 1 together with FIG. 2 that the automatic cleaner for a toilet seat in accordance with the present invention includes a cleaner 1 and a toilet seat 2. The cleaner 1 is box-shaped and consists of a seat body 102 and an outer lid 101 while the cleaner 1 is provided with a washing device 11, a flushing device 12, a drier 13 and a transmission unit 14. The toilet seat 2 consists of a turning seat 21 and a bottom seat 22. When the transmission unit 14 inside of the cleaner 1 brings the turning seat 21 of the toilet seat 2 into rotation, the cleaner 1 inside of the cleaner 1 will spray a certain amount of cleaning agent (water or other liquid) while the washing device 11 is operated for washing, whereupon the drier 13 dries the surface of the turning seat 21. Accordingly, a clean, hygienic and warming toilet seat is attainable.

Figure 3:
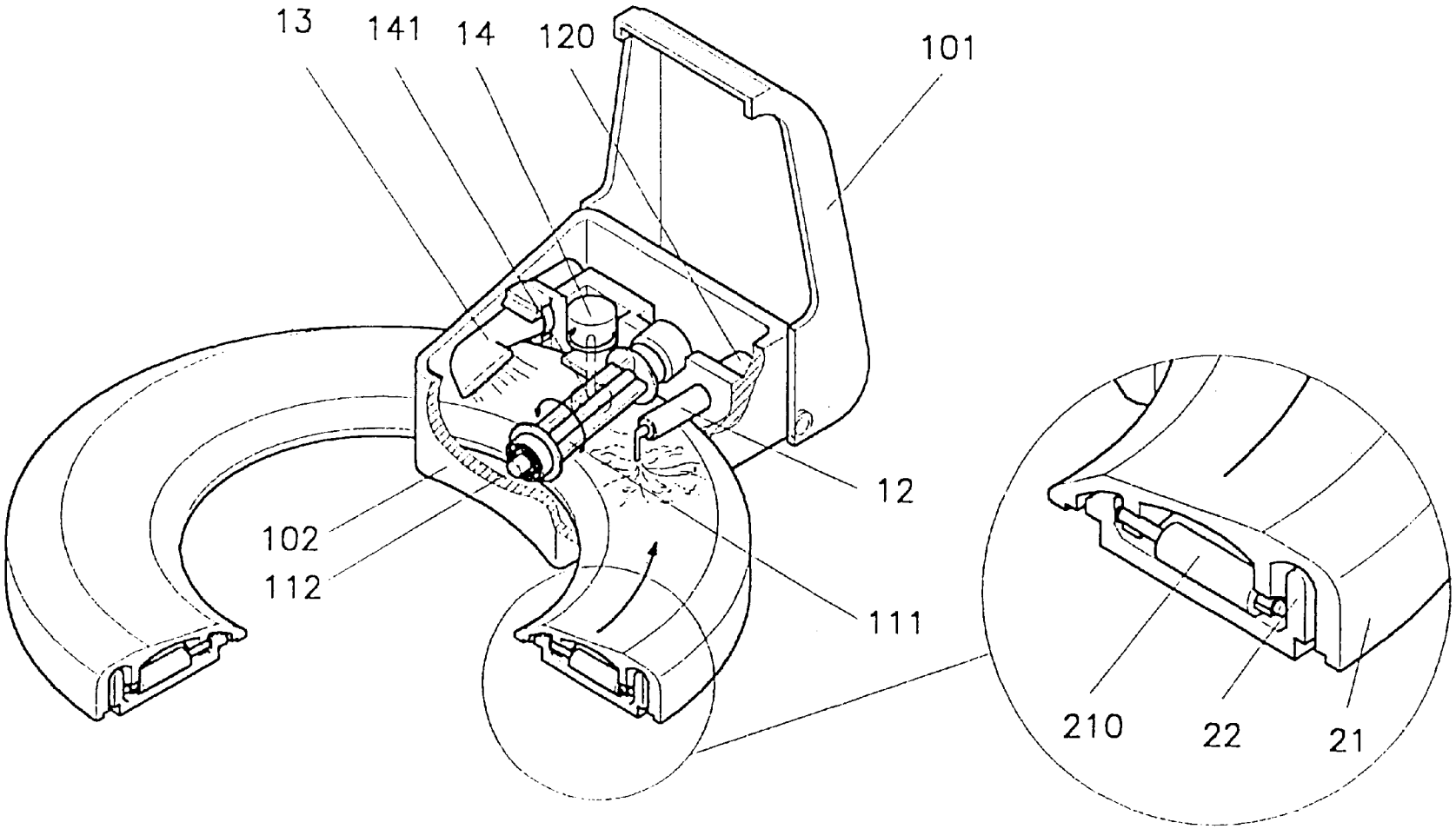
FIG. 3 is a perspective view of the preferred embodiment of the present invention.
Figure 4:
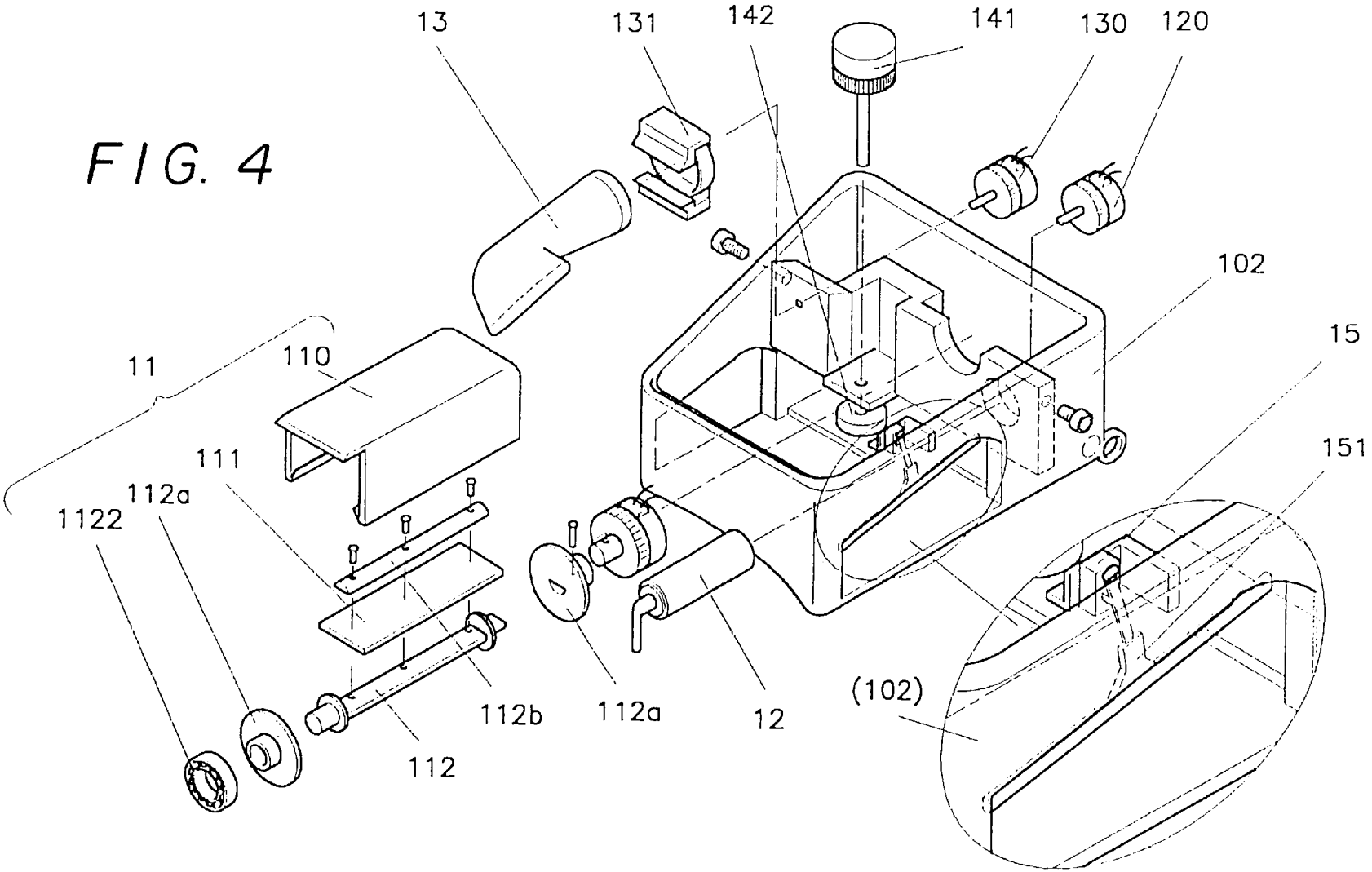
FIG. 4 is a perspective exploded view of the present invention.
Figure 4B:
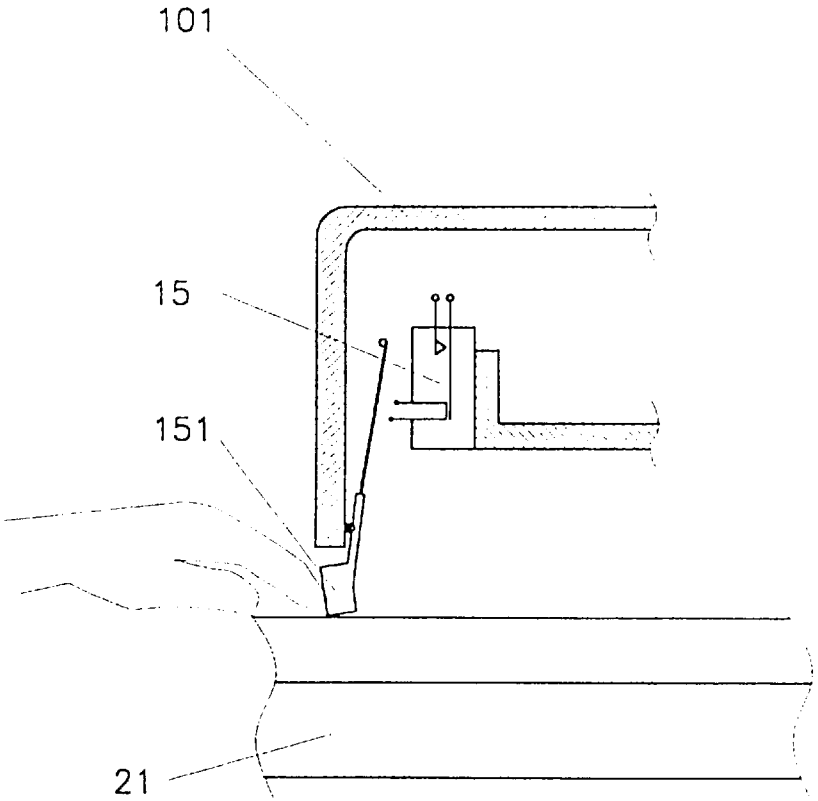
FIG. 4B is a second schematic drawing of a touch-controlling type device of the present invention.
Figure 4A:
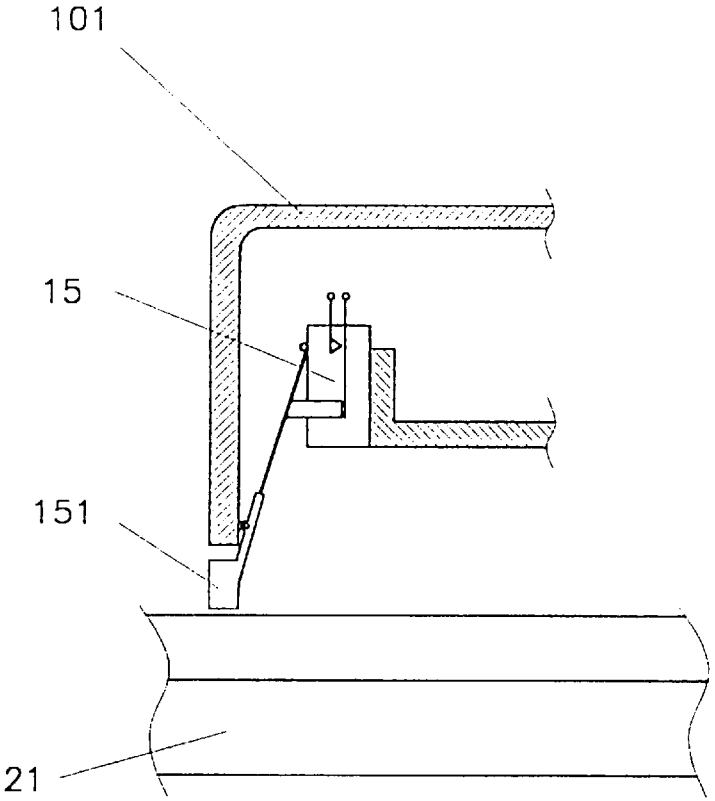
FIG. 4A is a first schematic drawing of a touch-controlling type device of the present invention.

FIG. 3 shows a perspective view of the preferred embodiment of the present invention. The internal structure of the present invention is apparent from FIG. 3 along with FIG. 4. The washing device 11 contains a covering body 110 in which a swivel shaft 112 of a brushing piece 111 is clamped by a clamping piece 112*b*. The swivel shaft 112 is provided with a shaft seat 112*a* at two ends thereof respectively. The shaft seat 112*a* at one end of the swivel shaft 112 is connected with a motor while the other seat 112*a* at the other end of thereof is joined with a bearing 1122. The rear end of the flushing device 12 is provided with a flushing motor 120. The drier 13 is driven by a motor fan 130 fixed by a fixing seat 131 at one side thereof. The transmission unit 14 includes a motor 141 coupled with a turning wheel 142 which is in contact with the side of the turning seat 21. The turning seat 21 contains a plurality of rollers 210 at bottom thereof so that the turning seat 21 turns itself on the bottom seat 22. A touch switch 15 is disposed at the inner rim of the rotary forward side of the turning seat 21 of the seat body 102. The function thereof is shown in FIGS. 4A and 4B. When a finger or a strange body is rolled into by the rotation of the turning seat 21, the touch switch 15 will be activated to disconnect the power for stopping the rotation to ensure the safety of the user.

Figure 3A:
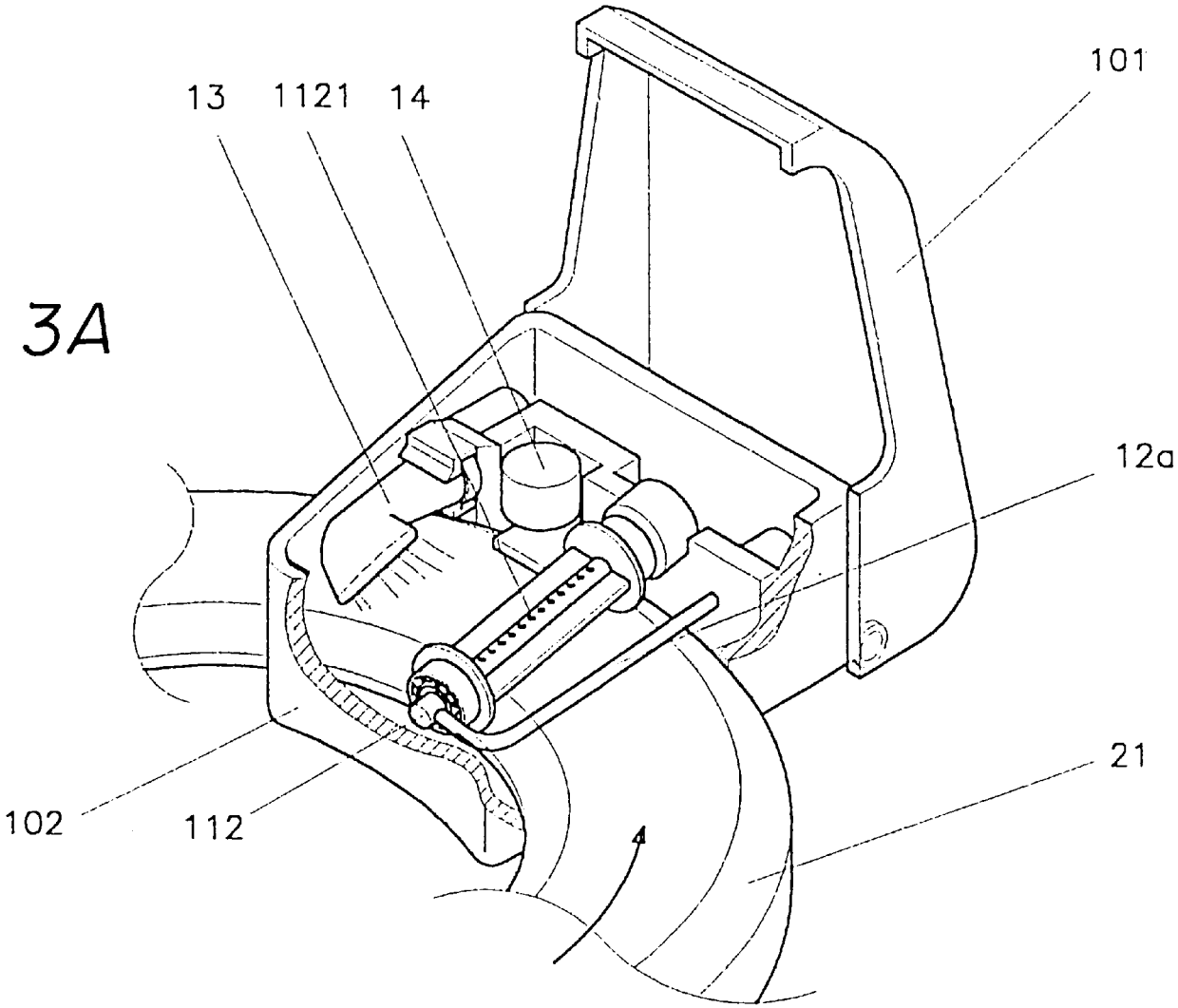
FIG. 3A is a perspective view of another preferred embodiment of the present invention.

FIG. 3A shows a perspective view of another preferred embodiment of the present invention. The flushing device 12 of the present invention can be constructed as a water pipe 12*a* while the swivel shaft 112 is designed to be a hollow type and contains water-spraying holes 1121. The water pipe 12*a* and the swivel shaft 112 are secured together so that the washing-up liquid sprays out of the water-spraying holes 1121 in using the present invention. Accordingly, the cleansing effect is also achieved.

Figure 5:
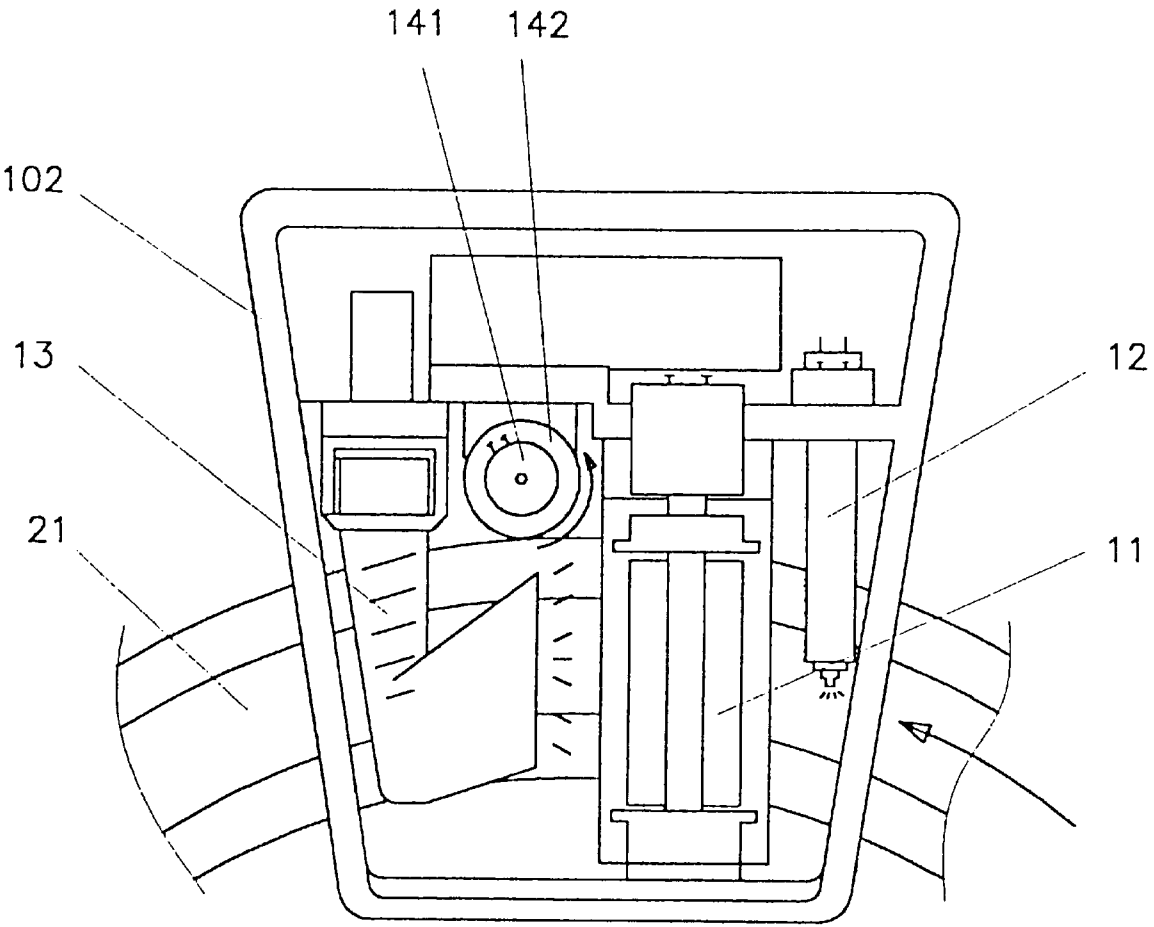
FIG. 5 is a first schematic drawing of the present invention showing the operation thereof.

FIG. 5 shows a first schematic drawing of the present invention showing the operation thereof. The use of the transmission unit 14 is apparent from FIG. 5. The motor 141 brings the turning wheel 142 into rotation while the turning seat 21 is also rotated by means of the frictional force which is produced when the turning wheel 142 and the turning seat 21 are in contact with each other.

Figure 5A:
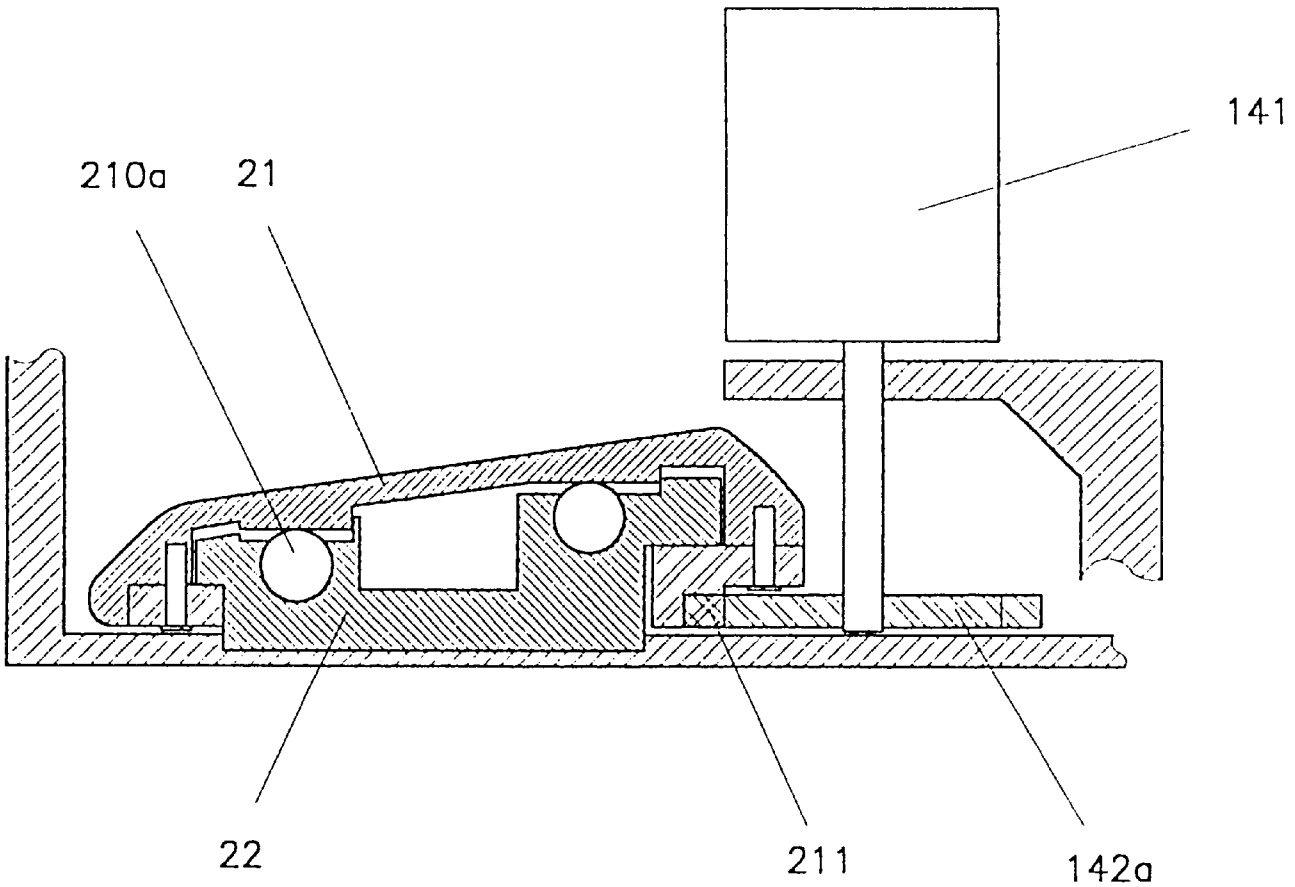
FIG. 5A is a schematic drawing of a further embodiment of the present invention showing the operation thereof.
Figure 5B:
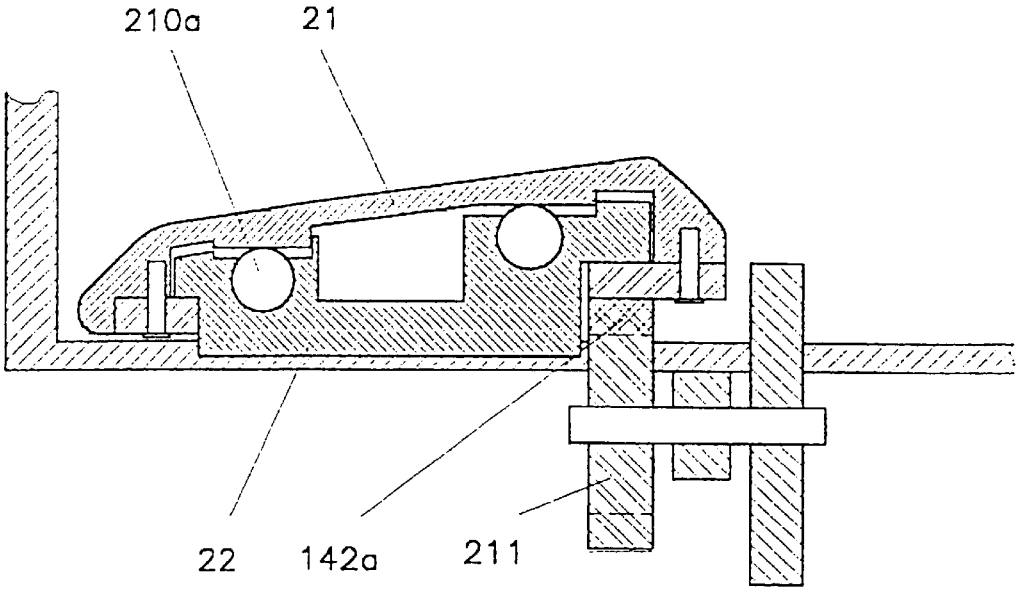
FIG. 5B is a schematic drawing of still another embodiment of the present invention showing the operation thereof.
Figure 5C:
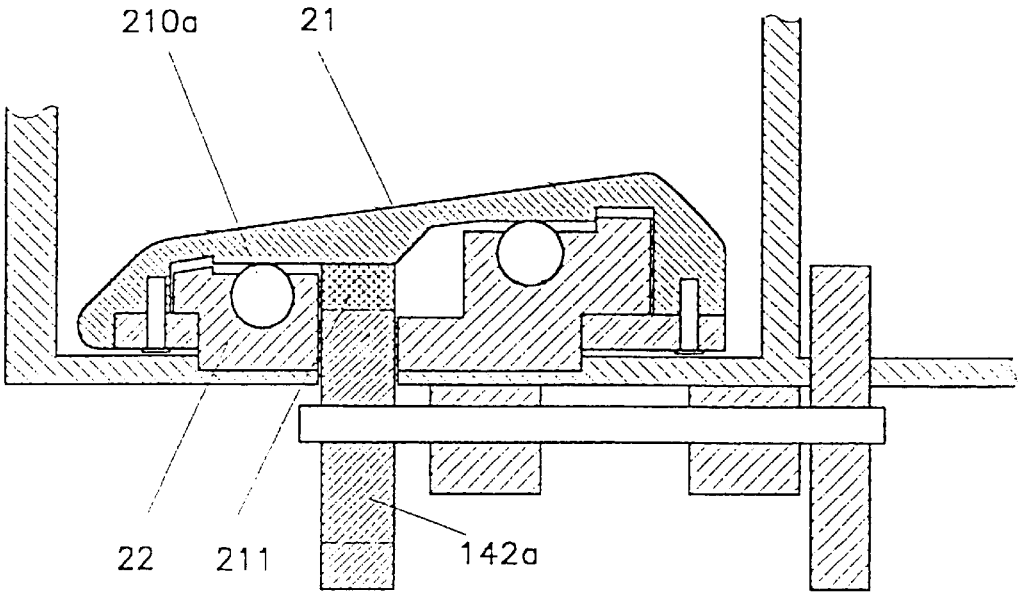
FIG. 5C is a schematic drawing of still a further embodiment of the present invention showing the operation thereof.

FIG. 5A shows a schematic drawing of a further embodiment of the present invention showing the operation thereof. It's apparent from FIG. 5 that a plurality of steel balls 210*a* are provided at proper position of the bottom seat 22 and used as rotary interface of the turning seat 21. In addition, the side of the turning seat 21 is fitted with transmission teeth 211 and provided with drive gear 142*a* for engaging therewith. When the drive gear 142*a* is driven by the motor 141, the turning seat 21 will also be rotated. Referring to FIG. 5B, the transmission teeth 211 is installable at proper position near the side bottom of the turning seat 21 while the drive gear 142*a* is disposed horizontally. Accordingly, the same effect is also attainable. Referring to FIG. 5C, the transmission teeth 211 is disposed at proper position near the section center of the bottom of the turning seat 21 while a grooved hole is disposed at corresponding position of the bottom seat 22 for inserting the drive gear 142*a* through the grooved hole to be in engagement with the transmission teeth 211. The same effect is also achievable.

Figure 6:
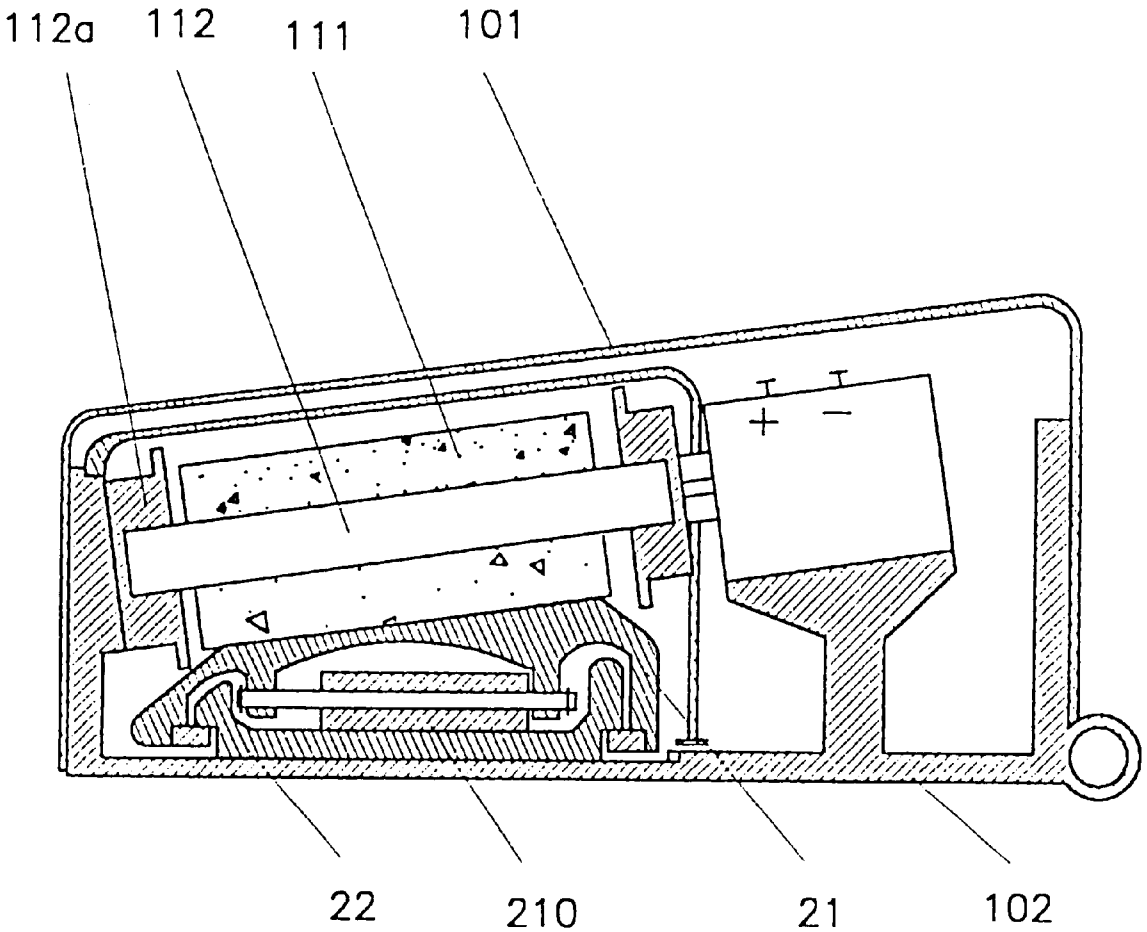
FIG. 6 is a second schematic drawing of the present invention showing the operation thereof.
Figure 6A:
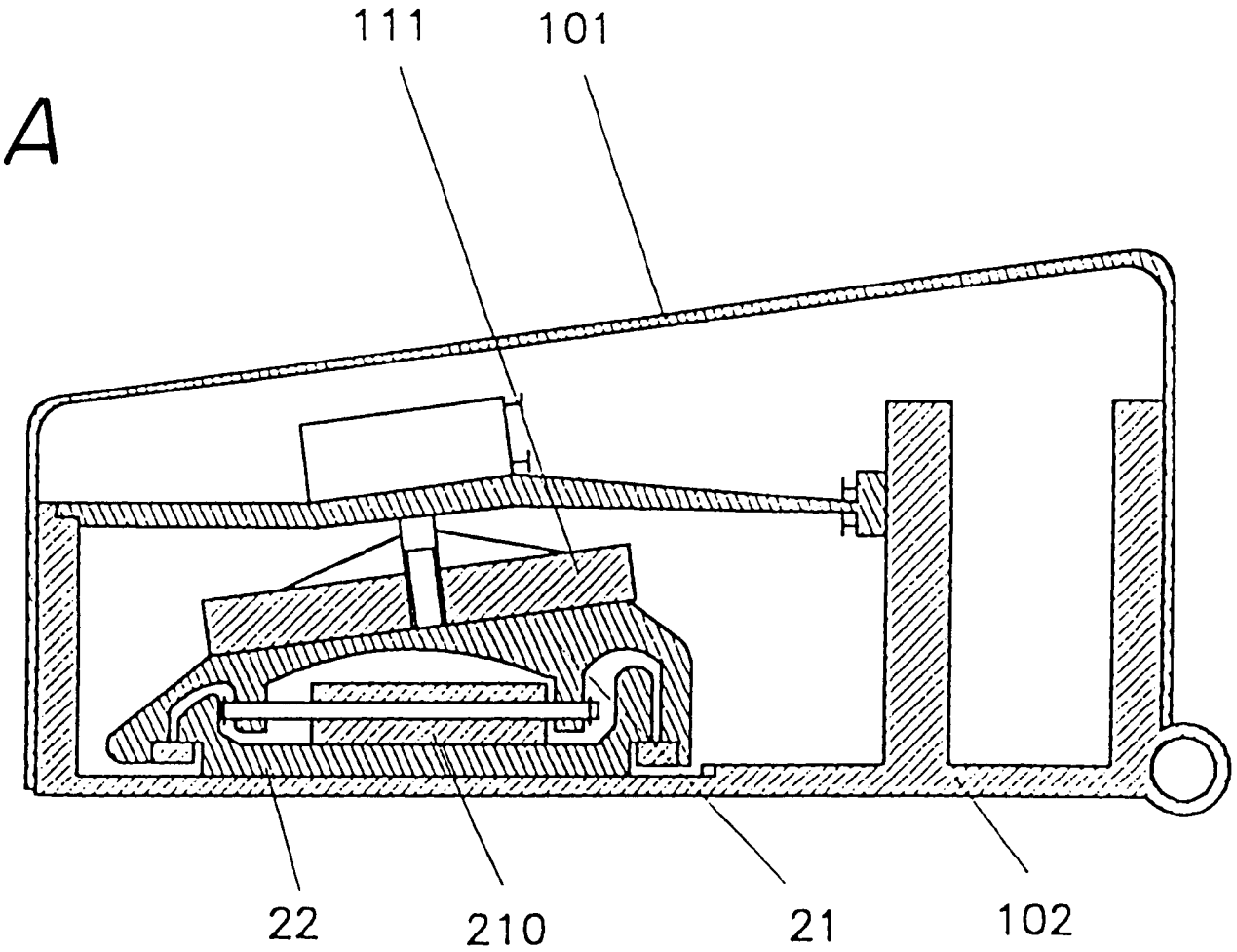
FIG. 6A is a third schematic drawing of the present invention showing the operation thereof.
Figure 6B:
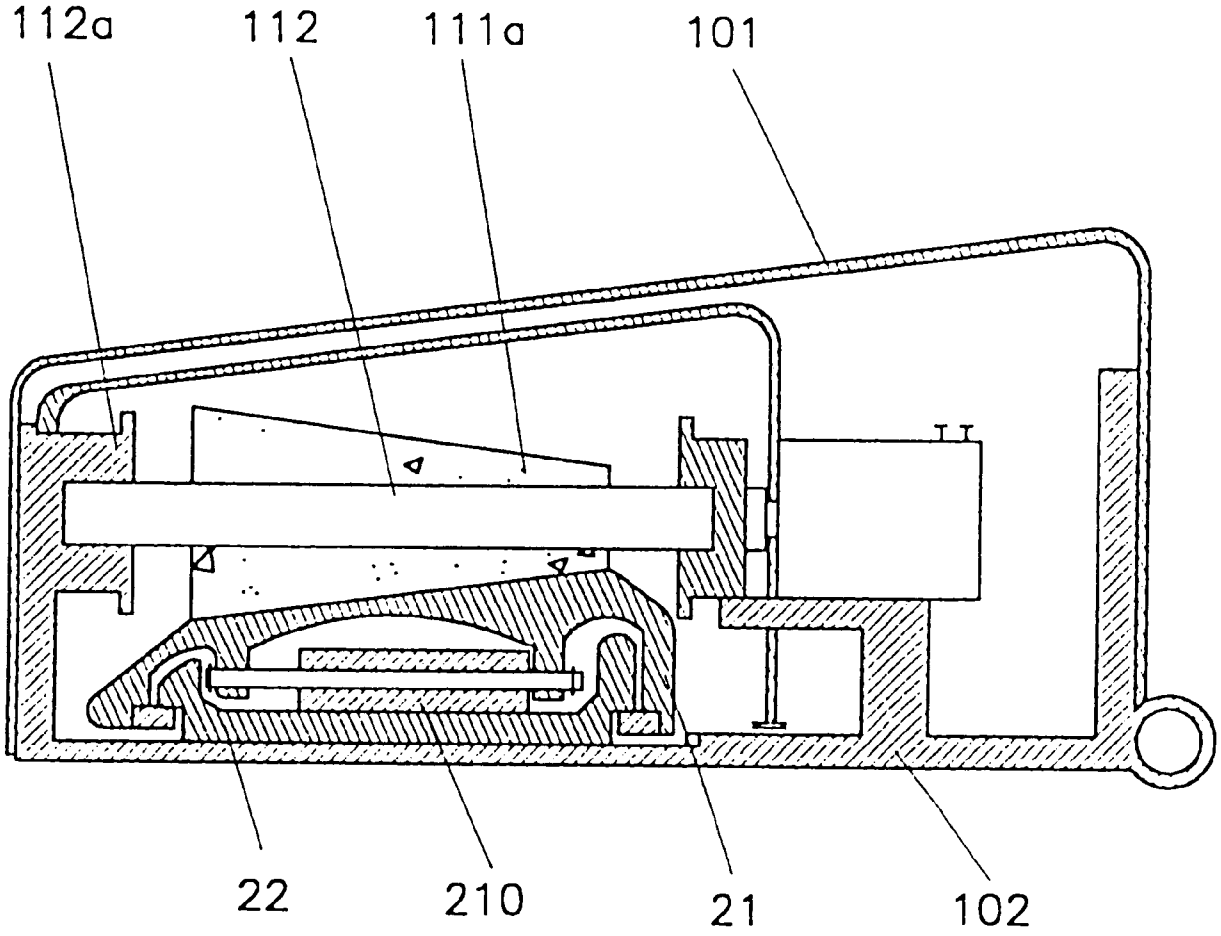
FIG. 6B is a fourth schematic drawing of the present invention showing the operation thereof.

FIG. 6 shows a second schematic drawing of the present invention showing the operation thereof. The operation of the washing device 11 is apparent from FIG. 6. The side of the brushing piece 111 disposed parallel to the surface of the turning seat 21 is in contact with the surface of the turning seat 21 while the turning seat 21 is moved by a motor. Referring to FIG. 6, the motor is disposed vertically. The brushing piece 111 is coupled at bottom of the motor so that the bottom of the brushing piece 111 is in contact with the surface of the turning seat 21. Accordingly, the same brushing effect is attainable. Referring to FIG. 6B, the brushing piece 111 is constructed in the same shape corresponding to the surface form of the turning seat 21 while the swivel shaft 112 is horizontally disposed. Accordingly, the same brushing effect is attainable as well.

Figure 7:
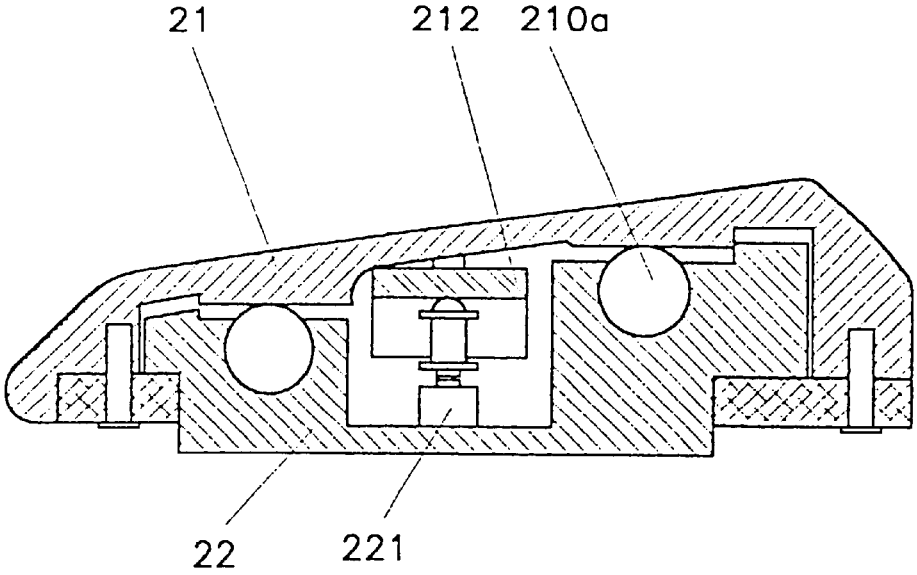
FIG. 7 is a cross section of the toilet seat of a further embodiment of the present invention.
Figure 7A:
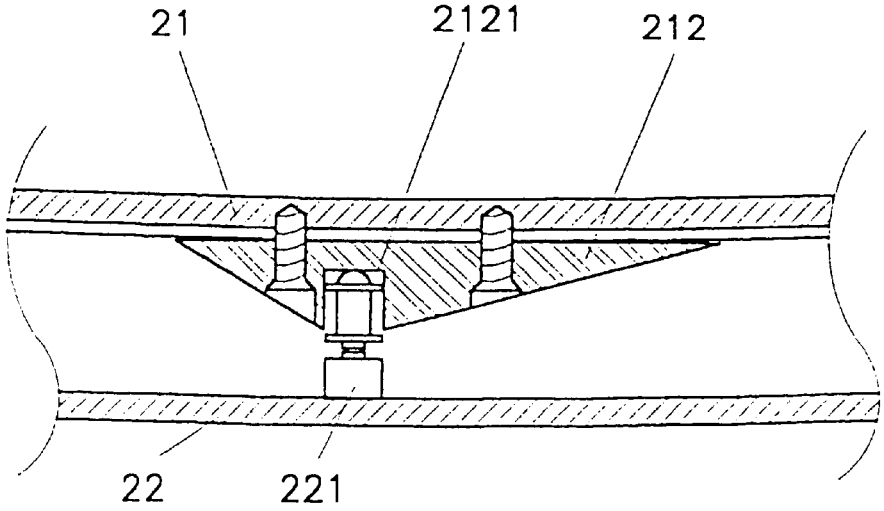
FIG. 7A is a longitudinal section of the toilet seat of the further embodiment of the present invention.

FIG. 7 shows a cross section of the toilet seat of a further embodiment of the present invention. It's apparent from FIG. 7 together with FIG. 7A, a touch-controlling piece 212 is installed at proper position of the bottom of the turning seat 21. A reed switch 221 is disposed at corresponding position of the bottom seat 22. The reed switch 221 is locked in a groove 2121 of the touch-controlling piece 212 when the reed switch 221 is located in position. Therefore, the turning seat 21 is positioned and can't be rotated any more. In cleaning, the reed switch 221 draws itself downwards and is separated from the groove 2121 so that the turning seat 21 is smoothly rotated and cleaned. When turning around once, an incline of the touch-controlling piece 212 is in contact with the reed switch 221 so that the whole cleaning action is finished and stopped. Then, the reed switch 221 restores itself in the groove 2121, and the turning seat 21 is positioned and can't be turned any more. Accordingly, the using safety is ensured.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. An automatic cleaner for a toilet seat primarily comprising a cleaner and a toilet seat, wherein the improvement is characterized by:

said cleaner having a washing device whose brushing piece is installed on a swivel shaft and which is driven by a motor, a flushing device used to spray a certain amount of cleaning liquid, a drier and a transmission unit used to drive a turning wheel, said toilet seat having a turning seat provided with a plurality of rollers at certain position thereof and a bottom seat, said turning seat making a rotary movement thereon, and wherein, in assembly, said turning wheel is in contact with said turning seat so that said turning seat is brought into rotation, and said brushing piece is in contact with the surface of said turning seat, and wherein, when said transmission unit within said cleaner brings said turning seat of said toilet seat into rotation, said flushing device within said cleaner sprays cleaning liquid in order for said washing device to carry out the cleaning task while said drier dries the surface of said turning seat to achieve a clean, hygienic and warming effect.

2. An automatic cleaner for a toilet seat as claimed in claim 1, wherein a motor of said washing device is constructed vertically, and wherein said brushing piece is install on said swivel shaft at bottom of said motor and in contact with the top of said turning seat for washing the surface of said bottom seat.

3. An automatic cleaner for a toilet seat as claimed in claim 1, wherein the form of the side of said brushing piece corresponds to that of the surface of said turning seat, and the both are joined together, and wherein said swivel shaft is constructed horizontally.

4. An automatic cleaner for a toilet seat as claimed in claim 1, wherein said flushing device is attached to a hollow turning shaft fitted with spraying holes by means of a water pipe so that the cleaning liquid sprays out of said spraying holes.

5. An automatic cleaner for a toilet seat as claimed in claim 1, wherein said transmission unit is fitted with a drive gear, and one side of said turning seat is provided with transmission teeth for engaging with said drive gear so that said turning seat can brought into rotation.

6. An automatic cleaner for a toilet seat as claimed in claim 5, wherein said drive gear is disposed laterally, and said transmission of said turning seat teeth are disposed at the bottom near the side thereof for engaging with said drive gear.

7. An automatic cleaner for a toilet seat as claimed in claim 5, wherein said transmission teeth of said turning seat is disposed at proper position near the center of said bottom seat, and a grooved hole is disposed at corresponding position of said bottom seat while said lateral drive gear passes through said grooved hole for engaging with said transmission teeth.

8. An automatic cleaner for a toilet seat as claimed in claim 1, wherein a touch switch is disposed at side of an outer lid and at the rotary forward side of said turning seat and is coupled with a touch piece, and wherein, when a finger or a strange body is rolled into with the rotation of the turning seat, the touch piece is contacted to disconnect the touch switch for stopping the rotation to ensure the safety of the user.

9. An automatic cleaner for a toilet seat as claimed in claim 1, wherein a plurality of steel balls are provided at proper position of said bottom seat and used as rotary interface of said turning seat.

10. An automatic cleaner for a toilet seat as claimed in claim 1, wherein a touch-controlling piece fitted with a groove is installed at proper position of the bottom of said turning seat, and wherein a reed switch is disposed at corresponding position of said bottom seat to said groove, and said reed switch is locked in said groove in ordinary state so that said turning seat can't be rotated any more, and wherein, in cleaning, said reed switch draws itself downwards and said turning seat is smoothly rotated and cleaned, and wherein, when turning around once, an incline of said touch-controlling piece is in contact with said reed switch so that the whole cleaning action is finished and stopped, then, said reed switch restores itself in said groove so that said turning seat is positioned and can't be turned any more.

* * * * *